US007665925B2

(12) United States Patent
Sakata et al.

(10) Patent No.: US 7,665,925 B2
(45) Date of Patent: Feb. 23, 2010

(54) BINDER AND BINDING DEVICE

(75) Inventors: Tomoaki Sakata, Tokyo (JP); Toru Yoshie, Tokyo (JP)

(73) Assignee: Max Co., Ltd., Tokyo (JP)

( * ) Notice: Subject to any disclaimer, the term of this patent is extended or adjusted under 35 U.S.C. 154(b) by 784 days.

(21) Appl. No.: 10/512,681

(22) PCT Filed: Apr. 25, 2003

(86) PCT No.: PCT/JP03/05378

§ 371 (c)(1),
(2), (4) Date: Oct. 27, 2004

(87) PCT Pub. No.: WO03/093025

PCT Pub. Date: Nov. 13, 2003

(65) Prior Publication Data

US 2005/0175434 A1 Aug. 11, 2005

(30) Foreign Application Priority Data

Apr. 30, 2002 (JP) ..... 2002-129236
Feb. 6, 2003 (JP) ..... 2003-029302

(51) Int. Cl.
*B42F 13/22* (2006.01)

(52) U.S. Cl. ..... 402/31; 412/6

(58) Field of Classification Search ..... 412/6, 412/33, 38, 42, 43; 402/19, 20, 23, 26, 4, 402/5, 31, 39, 42, 70, 73, 80 R; 281/21.1
See application file for complete search history.

(56) References Cited

U.S. PATENT DOCUMENTS

| | | | | |
|---|---|---|---|---|
| 2,337,997 | A * | 12/1943 | Hiromi et al. | 29/888.076 |
| 3,613,878 | A * | 10/1971 | Langas et al. | 206/340 |
| 4,607,970 | A * | 8/1986 | Heusinkveld | 402/20 |
| 5,618,122 | A | 4/1997 | Constantine | |
| 6,062,792 | A * | 5/2000 | Garrity | 412/39 |
| 6,419,416 | B1 * | 7/2002 | Tomoda | 402/18 |
| 6,761,497 | B2 * | 7/2004 | Kaneda | 402/31 |
| D508,947 | S * | 8/2005 | Yoshie | D19/32 |
| 7,077,595 | B2 * | 7/2006 | Knight | 402/39 |
| 2003/0031502 | A1 * | 2/2003 | Rothschild | 402/60 |

(Continued)

FOREIGN PATENT DOCUMENTS

EP 1 054 780 B1 7/2002

(Continued)

*Primary Examiner*—Dana Ross
*Assistant Examiner*—Pradeep C Battula
(74) *Attorney, Agent, or Firm*—Morgan, Lewis & Bockius LLP

(57) ABSTRACT

A number of ½ ring parts (13 and 14) are arranged at constant intervals on both sides of the spine portion (12) of binders, and the spine portion (12) and the ½ ring parts (13 and 14) on both upper and lower sides are coupled together via thin hinges. As the spine portion (12) is not in double-split hinge structure, which is different from the case of conventional binders, it is ensured that the spine portion is held until the termination of the binding operation when a binding apparatus is used for causing a holding mechanism to clutch the spine portion of the binders so as to set the binders to face the back of sheets of loose-leaf paper and also causing an engaging mechanism to close and engage the ½ ring parts.

28 Claims, 16 Drawing Sheets

U.S. PATENT DOCUMENTS

| | | | | |
|---|---|---|---|---|
| 2003/0206765 | A1* | 11/2003 | Kaneda | 402/31 |
| 2004/0018041 | A1* | 1/2004 | Amdahl et al. | 402/26 |

FOREIGN PATENT DOCUMENTS

| | | |
|---|---|---|
| JP | 45-7800 | 4/1970 |
| JP | 54-84162 | 7/1979 |
| JP | 57-500920 | 5/1982 |
| JP | 57-199695 | 12/1982 |
| JP | 58-31165 | 3/1983 |
| JP | 61-138564 | 8/1986 |
| JP | 2-10074 | 1/1990 |
| JP | 2-303892 | 12/1990 |
| JP | 3-52255 | 5/1991 |
| JP | 5-162478 | 6/1993 |
| JP | 6-312589 | 11/1994 |
| JP | 7-208424 | 8/1995 |
| JP | 8-039497 | 2/1996 |
| JP | 8-135632 | 5/1996 |
| JP | 3042732 | 8/1997 |
| JP | 9-240184 | 9/1997 |
| JP | 3055955 | 11/1998 |
| JP | 2000-289376 | 10/2000 |
| JP | 2001-129795 | 5/2001 |
| JP | 2002-502728 | 1/2002 |

* cited by examiner

BINDER AND BINDING DEVICE

This application claims the benefit of the earlier filing date of Japanese Patent Application No. 2002-129236 filed 30 Apr. 2002, and Japanese Patent Application No. 2003-029302 filed 6 Feb. 2003, which are hereby incorporated by reference in the entirety.

TECHNICAL FIELD

The present invention relates to a binder for binding sheets of loose-leaf paper and to a binding apparatus for automatically fitting the binder to the sheets of loose-leaf paper.

BACKGROUND ART

A plastic binder for binding sheets of loose-leaf paper and documents perforated with multiple-hole paper punchers (refer to JP-A-2000-289376, for example) are known. A binder of the sort mentioned above will be described briefly herein below. FIGS. 20, 21 and 22 show a conventional binder 1 with a number of ½ ring parts 3 and 4 arranged at constant intervals on both side edges of spine portions 2, which are respectively formed into double-split hinges by monolithic molding. As shown in the drawings above, a projection 5 is formed at the tip of each ½ ring part 3 in the upper line and has a bulged tip, whereas a depression 6 corresponding in configuration to the bulged tip of the projection 5 is formed in the tip of each ½ ring part 4 in the lower line so that the upper and lower ½ ring parts 3 and 4 can be engaged together by press-fitting the projection 5 into the depression 6. When sheets of loose-leaf paper are bound with the binder 1, the ½ ring parts 3 lined up on one side or the ½ ring parts 4 lined up on the other are passed through the holes of the paper and the two lines of ½ ring parts 3 and 4 are closed up manually. As the projections 5 of the ½ ring parts 3 are engaged with the depressions 6 of the ½ ring parts 4 to form rings, the sheets of loose-leaf paper are bound up.

Heretofore, the work of binding documents with a binder has been done manually and it takes much labor to follow the steps of passing many ½ ring parts through the holes of paper and closing the two lines of ½ ring parts manually. Moreover, this work requires a great deal of time, particularly when many documents are bound up. It is therefore an object of the invention to provide a binding apparatus capable of efficiently doing binding work by means of a plastic binder without using the hands.

When a binding apparatus for performing a binding process is constructed, it will become necessary to provide a holding mechanism for setting a binder to face the back of loose-leaf paper by clutching the spine portion of the binder and an engaging mechanism for engaging the ½ ring parts of the binder by closing the ½ ring parts. Since the spine portion of the conventional binder is in the form of a double-split hinge and opened and closed together with the ½ ring parts, the holding mechanism is hardly able to keep hold of the spine portions when the engaging mechanism closes the ½ ring parts. Consequently, there is the possibility that the binder will slip off the holding mechanism, so that the conventional binder is considered unfeasible for use in the binding apparatus. It is therefore another object of the invention to provide a binder adapted for being usable by a binding apparatus.

Further, the above conventional binder is in the form of a double-split ring and when the plurality of binders are stacked up, there is produced a gap between the binders as shown in FIG. 21(*b*) because of the difference between the inner and the outer diameters of the respective ½ ring parts 3 and 4. The drawback is that it is inconvenient to carry the binders as the binders may be dismembered while being handled and the binders are rendered bulky when they are packaged. In case that the binding process is mechanized, moreover, a large amount of binders are necessarily charged into a binding machine and the conventional binder will necessitate a large storage space and this constitutes an obstacle to reducing the machine size. It is therefore still another object of the invention to provide a space-saving, easy-to-handle binder.

In the case of the above conventional binder, further, the projection projected circumferentially from the tip of each ½ ring part on one side and the depression formed in the tip of each ½ ring part on the other are used for forming the engaging means for engaging the ½ ring parts. Therefore, use has to be made of a pattern drawing means such as rotary drawing for forming the projection in such a shape that its tip is bulged and the depression 6 in such a shape that its interior is also bulged symmetrically about the projection, so that the metal mold tends to become complicated in structure, thus increasing the production cost. Although the number of sheets that can be bound up is increased by decreasing the thickness of the ring part in its radial direction, the projection and the depression will have to be made to the suitable measurements so as to secure the engaging strength, which causes the tip portion of the ring part to necessarily grow thicker than the diameters of the projection and the depression, whereby it is difficult to form a slender ring part. It is therefore a further object to decrease the production cost of a binder as well as forming slender ring parts.

DISCLOSURE OF THE INVENTION

The invention is proposed to accomplish the objects above by providing a binding apparatus for binding sheets of loose-leaf paper, using a binder that disposes split ring parts on both sides of a spine portion in parallel with each other, comprising: a paper table; a binder holding portion for holding both ends of the spine portion of the binder, conveying the binder from a source of a binder supply and setting the binder to face the back of the sheets of loose-leaf paper on the paper table; a hoisting stopper portion, for positioning the loose-leaf paper, that is positioned in front of the spine portion of the binder held by the binder holding portions and in the rear of the back of the sheets of loose-leaf paper on the paper table; a binding portion for closing and engaging the split ring parts of the binder by pushing the split ring parts from behind; and control means that sequentially control the binder holding portion, the stopper portion and the binding portion, wherein one-cycle work of fitting the binder to the sheets of loose-leaf paper is automatically conducted.

Further, the invention provides a binding apparatus, wherein a plurality of slits are formed with the same pitch as the ring pitch of the binder in the rear edge portion of the paper table so as to close and engage the ring parts of the binder through the holes of the sheets of loose-leaf paper and the slits.

Further, the invention provides a binding apparatus, wherein the binder holding portion comprises a pinch portion capable of opening and closing so as to clutch both ends of the spine portion of the binder by driving the pinch portions to open and close.

Further, the invention provides a binding apparatus, wherein the stopper portion comprises a plurality of stopper pins, arranged with integral multiple pitch of the ring pitch of the binder, that position the sheets of loose-leaf paper and support the spine portion of the binder.

Further, the invention provides a binding apparatus, wherein slits for preventing the interference of the stopper pins of the stopper portion at the time of advancing the binding portion are formed in the front edge portion of the binding portion for closing and engaging split ring parts of the binder by pushing the split ring parts from behind.

Further, the invention provides a binder having a spine portion; a number of split ring parts arranged at constant intervals on upper and lower edges on one side of the spine portion; and engaging means formed at both ends of each split ring part whereby to bind up sheets of loose-leaf paper by engaging both ends of each split ring part, the split ring parts being connected by upper and lower edges of the spine portion and a thin hinge.

Further, the invention provides a binder comprising: a spine portion; a number of split ring parts arranged at constant intervals on upper and lower edges on one side of the spine portion; and engaging means formed at both ends of each split ring part, whereby to bind sheets of loose-leaf paper by engaging both ends of each split ring part, wherein each split ring part comprises three members including an intermediate ring part and a pair of outer ring parts respectively coupled by a thin hinge to both ends of each intermediate ring, the spine portion is coupled with the intermediate ring part, and the pair of outer ring parts on both ends are capable of opening and engaging.

Further, the invention provides a binder comprising: a spine portion; split ring parts arranged at constant intervals on both side edges of the spine portion; and engaging means formed at both ends of the split ring part, whereby to bind sheets of loose-leaf paper by engaging both ends of each split ring part, wherein the spine portion is projected forward or backward, so that, when binders are stacked, the spine portion of one of the stacked binders is brought into contact with the spine portion of another of the stacked binders.

Further, the invention provides a binder comprising: a spine portion; split ring parts arranged at constant intervals on both side edges of the spine portion; and engaging means formed at both ends of the split ring part, whereby to bind sheets of loose-leaf paper by engaging both ends of each split ring part, wherein the outer and inner peripheral faces of the split ring part are formed to have the same curvature, so that, when binders are stacked, the back of one of the stacked binders is brought into contact with the front of another of the stacked binders.

Further, the invention provides a binder comprising: a spine portion; split ring parts arranged at constant intervals on both side edges of the spine portion; and engaging means formed at both ends of the split ring part, whereby to bind sheets of loose-leaf paper by engaging both ends of each split ring part, wherein each split ring part comprises three members including an intermediate ring part and a pair of outer ring parts respectively coupled by a thin hinge to both ends of each intermediate ring, and the outer and inner peripheral faces of at least the central split ring part having the same curvature, so that, when binders are stacked, the back of the central split ring part of one of the stacked binders is brought into contact with the front of the central split ring part of another of the stacked binders.

Further, the invention provides a binder wherein the respective tips of the three members of split ring parts are formed to trued up in a substantially straight line.

Further, the invention provides a binder comprising: a spine portion; split ring parts arranged at constant intervals on both side edges of the spine portion; and engaging means formed at both ends of the split ring part, whereby to bind sheets of loose-leaf paper by engaging both ends of each split ring part, wherein one or a plurality of depressions are formed on one of the front and the back of the spine portion, and one or plurality of projections are formed on the other of the front and the back of the spine portion so that the depressions and the projections are engaged mutually, whereby a plurality of binders can be coupled in a stacked condition.

Further, the invention provides a binder wherein the depression comprises a slit with long sideways including a pin hole portion for engageing with the projection and a broad slit portion continuous to the pin hole portion and having an outer diameter greater than that of the projection, and wherein the engagement between the pin hole portion and the projection can be released by sliding a pair of binders in an engaged condition relatively.

Further, the invention provides a binder wherein a joint region between the pin hole portion and the broad slit portion is made narrower than the outer diameter of the projection so that a click stop function for generating a resistance when the projection slidably moves from the pin hole portion to the broad slit portion is provided.

Further, the invention provides a binder comprising: a spine portion; split ring parts arranged at constant intervals on both side edges of the spine portion; and engaging means formed at both ends of the split ring part, whereby to bind sheets of loose-leaf paper by engaging both ends of each split ring part, wherein the engaging means comprises a scarf structure having radial, symmetrical steps at both ends of each split ring part, a hook portion formed at one end, and a catch portion formed at the other end for engaging with the hook portion.

Further, the invention provides a binder wherein the catch portion comprises a slot.

Further, the invention provides a binder comprising: a spine portion; split ring parts arranged at constant intervals on both side edges of the spine portion; and engaging means formed at both ends of the split ring part, whereby to bind sheets of loose-leaf paper by engaging both ends of each split ring part, wherein the engaging means comprise a scarf structure having radial, symmetrical steps at both ends of each split ring part, a hook portion formed on a surface side of the step of the split ring part on one side, and a catch portion formed on an undersurface side of the step of the split ring part on the other side for engaging with the hook portion.

Further, the invention provides a binder wherein the catch portion comprises a slot.

BRIEF DESCRIPTION OF THE DRAWINGS

FIG. 1(*a*) is a side view in an open condition; FIG. 1(*b*), a front view in the open condition; FIG. 1(*c*), a side view in a closed condition; and FIG. 1(*d*), a front view in the closed condition.

FIG. 2(*a*) is a side view in an open condition; and FIG. 2(*b*), a front view in an open condition.

FIG. 3(*a*) is a side view in an open condition; and FIG. 3(*b*), a front view in an open condition.

FIG. 11(*b*), a side view of the binder shown in FIG. 10.

FIG. 13(*b*), a sectional side view of the binder shown in FIG. 10.

FIG. 15(*a*) is a side view of the binder; and FIG. 15(*b*), a side view of the stacked-up binders.

FIG. 16(*a*) is a plan view; FIG. 16(*b*), a side view; and FIG. 16(*c*), a sectional side view.

FIG. 17(*a*) is a plan view; FIG. 17(*b*), a side view; and FIG. 17(*c*), a sectional side view.

FIG. 18(*b*), a side view of an engaging portion.

FIG. 19(*a*) is a front view of a central slit; FIG. 19(*b*), a front view of another slit; and FIG. 19(*c*), a front view of still another slit according to another embodiment of the invention.

FIG. 20(*a*) is a side view; and FIG. 20(*b*), a front view.

FIG. 21(*a*) is a side view; and FIG. 21(*b*), a side view of the stacked-up binders.

FIG. 22(*a*) is a side view; and FIG. 22(*b*), a side view of split ring parts in a engaged condition.

DESCRIPTION OF REFERENCE NUMERALS AND SIGNS

11 . . . binder, 12 . . . spine portion, 13, 14 . . . ½ ring parts, 15 . . . projection, 16 . . . depression, 21 . . . binder, 22, 23, 24 . . . ⅓ ring parts, 25 . . . spine portion, 31 . . . binder, 32 . . . 180° ring part, 33, 34 . . . 90° ring part, 35 . . . spine portion, 111 . . . binder, 112 . . . spine portion, 113 . . . central ⅓ ring part, 114 . . . upper-side ⅓ ring part, 115 . . . lower-side ⅓ ring part, 117 . . . hook portion, 118 . . . catch portion, 19 . . . stepped portion, 120 . . . stepped portion, 121 . . . inner base, 122 . . . slot, 124 . . . pin, 125, 126 . . . slits, 125*a* . . . pin hole portion, 125*b* . . . broad slit portion, 126*a* . . . pin hole portion, 126*b* . . . broad slit portion, 131 . . . binder, 132 . . . spine portion, 133 . . . central ⅓ ring part.

BEST MODE FOR CARRYING OUT THE INVENTION

Figure 1:
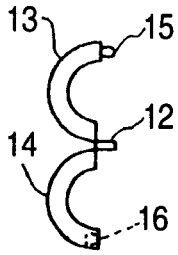
FIGS. 1(*a*)-(*d*) show a binder of the invention.
Figure 1:
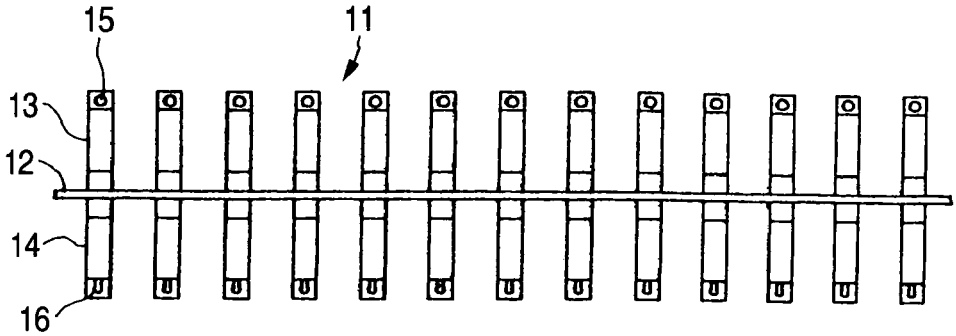
Figure 1:
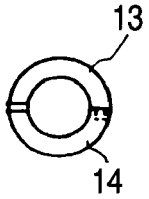
Figure 1:
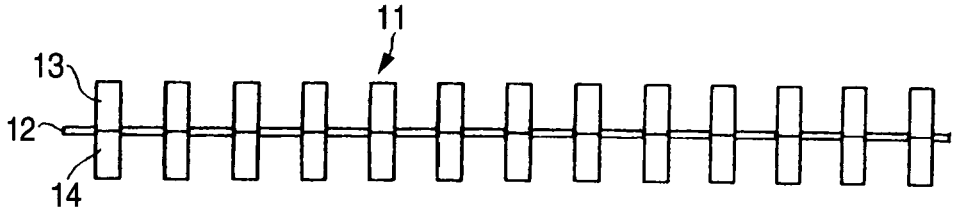

An embodiment of the invention will now be described in detail by reference to the drawings. FIGS. 1(*a*) to (*d*) show a plastic binder 11 with a spine portion 12 in the form of a thin board. A number of ½ ring parts 13 and 14 are arranged at constant intervals on upper and lower edges on one side of the long rear side of the spine portion, and the spine portion 12 and the respective ½ ring parts 13 and 14 on both upper and lower sides are coupled together via thin hinge portions in order to form monolithically molded parts. What makes this binder different from the conventional binder is that the spine portion 12 is not in the form of a double-split hinge and this is because when the binder is bound not manually but mechanically, the hinge structure with the opening and closing spine portion makes it difficult to clutch and keep holding the spine portion from the time when the binder is set until the termination of the binding operation. Engaging means are provided at the tips of the ½ ring parts 13 in the upper line and also at the tips of the ½ ring parts 14 in the lower line.

Figure 2:
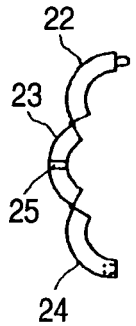
FIGS. 2(*a*) and (*b*) show a binder according to another embodiment of the invention.
Figure 2B:
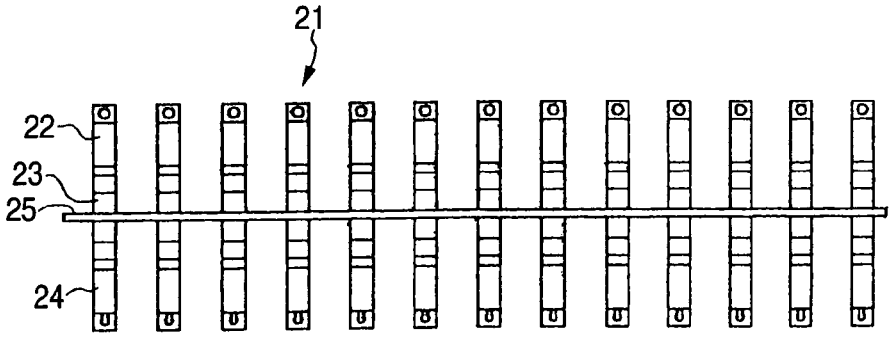
Figure 3:
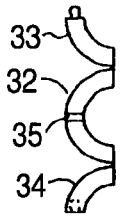
FIGS. 3(*a*) and (*b*) show a binder according to still another embodiment of the invention.
Figure 3:
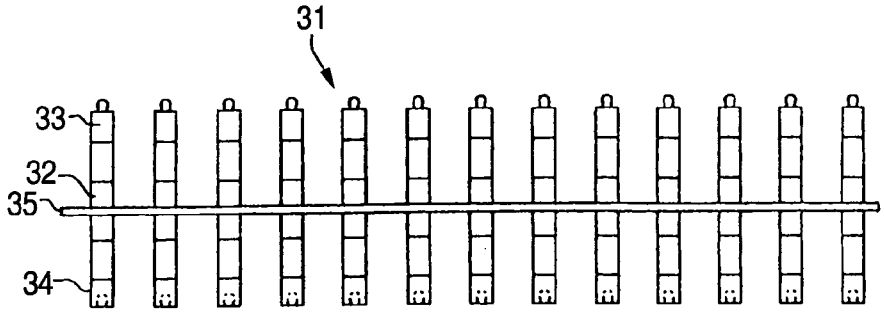

FIGS. 2(*a*) and (*b*) show a plastic binder 21 according to another embodiment of the invention, wherein each ring is divided into three 120° ⅓ ring parts 22, 23, 24 that are coupled together and an intermediate ⅓ ring part 23 is formed integrally with a spine portion 25. FIGS. 3(*a*) and (*b*) show a binder 31 according to still another embodiment of the invention, wherein each ring is divided into three parts: namely, a 180° ring part 32 and 90° ring parts 33 and 34 that are respectively coupled to the upper and lower 180° ring parts, and the intermediate 180° ring part 32 is formed integrally with a spine portion 35. As shown from FIG. 1(*a*) to FIG. 3(*b*), the binders 11, 21 and 31 are formed such that their spine portions are projected outside from both the rightmost and leftmost ring parts, so that the binders can be held by clutching both ends of the spine portions 12, 25 and 35.

Figure 10:
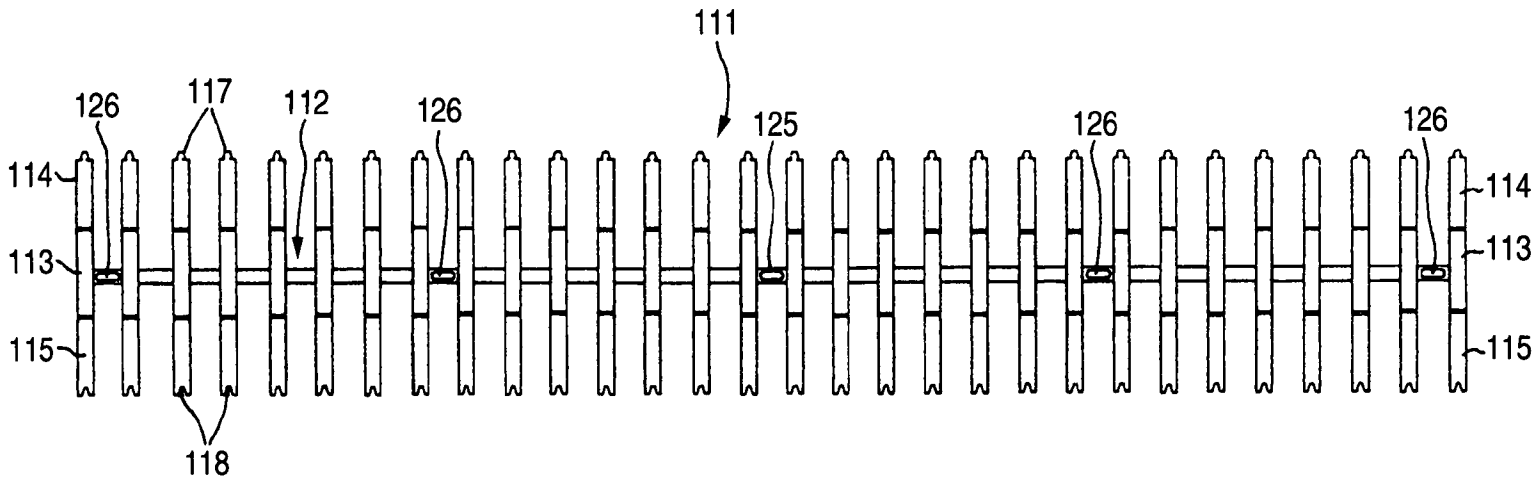
FIG. 10 is a rear view of a binder according to a further embodiment of the invention.
Figure 11:
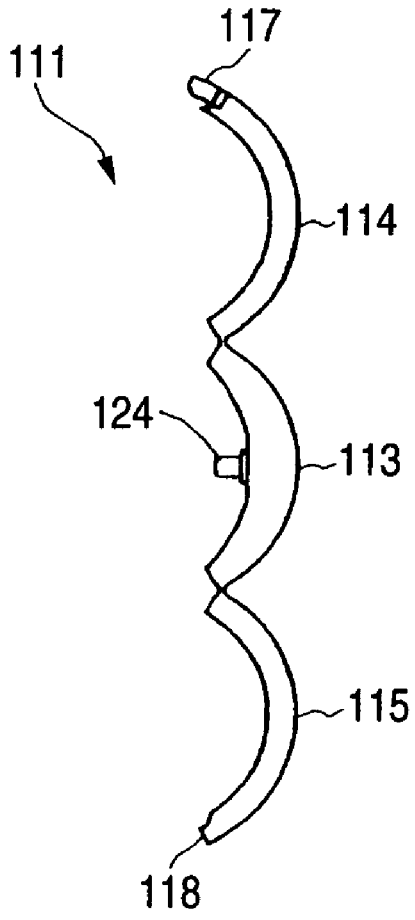
FIG. 11 (*a*) is a rear view of the binder shown in FIG. 10.
Figure 11:
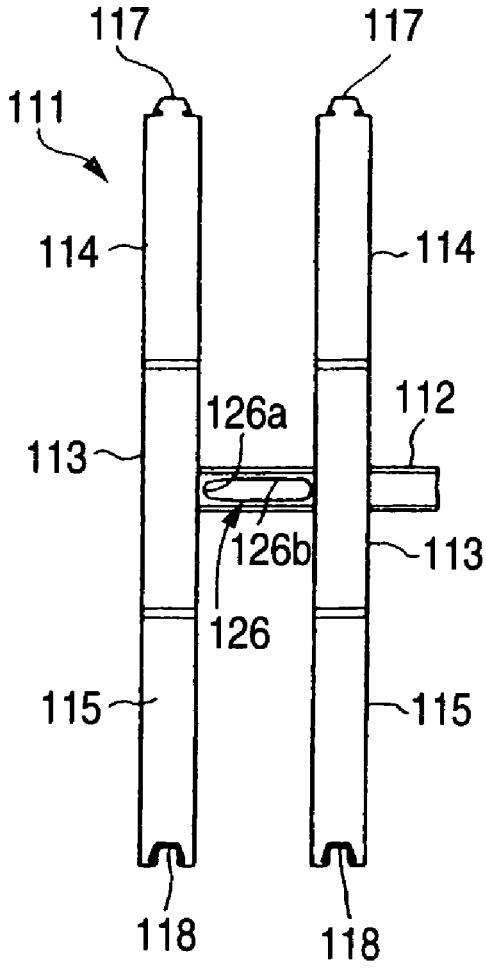
Figure 12:
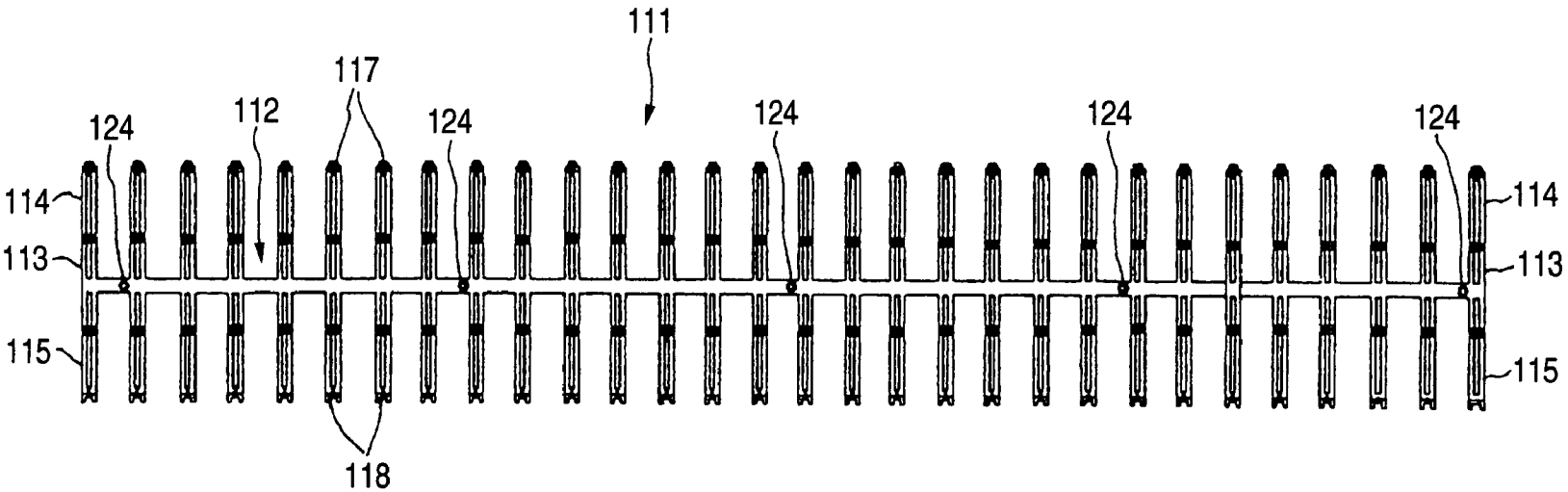
FIG. 12 is a front view of the binder shown in FIG. 10.

From FIG. 10 to FIG. 13(*b*), there are shown a binder 111 according to a further embodiment of the invention, in which the binder is formed of resin by injection molding with ring parts arranged at constant intervals on a spine portion 112 corresponding in length to standard-size paper. As shown in FIGS. 11(*a*) and (*b*) and FIGS. 13(*a*) and (*b*), each ring is divided into three parts including a central ⅓ ring part 113, and upper- and lower-side ⅓ ring parts 114 and 115 coupled to the central ⅓ ring part 113 and the ring is formed by bending, and engaging the tips of, the upper- and lower-side ⅓ ring parts 114 and 115.

Figure 13:
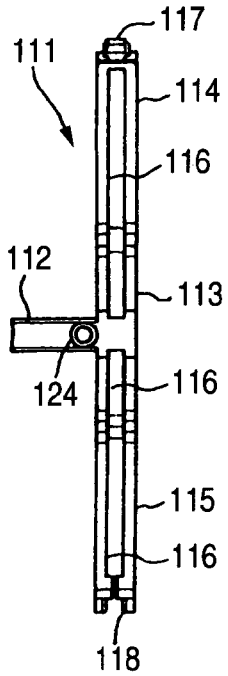
FIG. 13(*a*) is an enlarged front view of the binder shown in FIG. 10.
Figure 13:
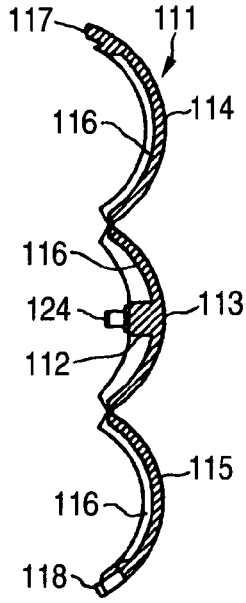
Figure 14:
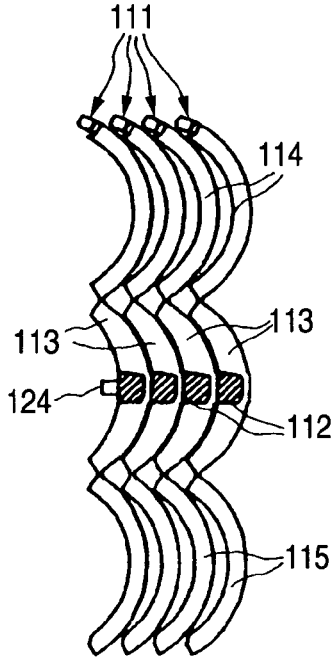
FIG. 14 is a side view of the binders shown in FIG. 10, which are stacked up.

As shown in FIGS. 11(*a*) and (*b*) and FIGS. 13(*a*) and (*b*), the curvature of the outer peripheral face of the central ⅓ ring part 113 is set equal to that of the inner peripheral face thereof and both edges of the respective ⅓ ring parts 113, 114 and 115 are trued up in a substantially straight line, whereby the central ⅓ ring parts 113 in front and in the rear make surface-to-surface contact with each other without leaving space therebetween when a plurality of binders 111 are stacked up as shown in FIG. 14. Consequently, this arrangement has the effect of taking up little space when the binders as a whole are packaged and when a binding machine is charged with such binders since the upper- and lower-side ⅓ ring parts 114 and 115 are thinner than the central ⅓ ring part 113.

Figure 15:
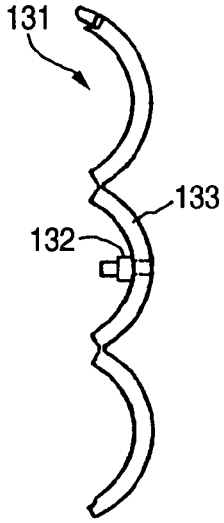
FIGS. 15(*a*) and (*b*) show a binder according a still further embodiment of the invention.
Figure 15:
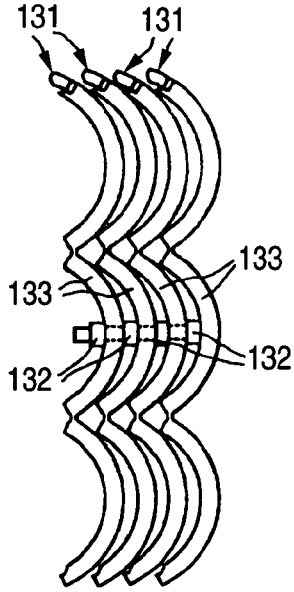

In case that a binding machine for continuously performing the binding process is constructed, a feed mechanism for successively conveying a plurality of binders forward is required. However, since the central ⅓ ring parts 113 of the binder 111 in front and in the rear adhere fast to each other and leave no space therebetween, there is no possibility that the binder is hindered from being fed by the push load of the feed mechanism as the binder warps, so that mechanization of the binding process can be dealt with. Incidentally, the binder 111 in front and in the rear need not always make surface-to-surface contact with each other by equalizing the curvatures of the outer and inner peripheral faces of the central ⅓ ring part 113. As in the case of a binder 131 (another embodiment) of FIGS. 15(*a*) and (*b*), for example, the same effect as what is obtained from the preceding example is also achievable by arranging the binder 131 in front and in the rear such that they make contact with each other at three points including the spine portion 132, and both upper and lower ends of each central ⅓ ring part 133.

As shown in FIGS. 13 (*a*) and (*b*), circumferential slots 116 are formed in the inner peripheral faces of the three respective ⅓ ring parts and a hook portion 117 is provided at the tip of the upper-side ⅓ ring part 114, whereas a catch portion 118 engaging with the hook portion 117 is formed at the tip of the lower-side ⅓ ring part 115.

Figure 16:
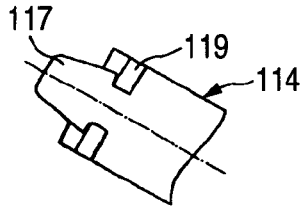
FIGS. 16(*a*) to (*c*) show a hook portion at the tip of the binder of FIG. 10.
Figure 16:
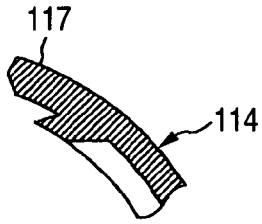
Figure 16:
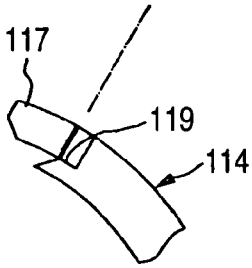
Figure 17:
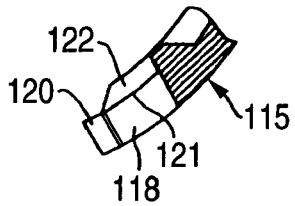
FIGS. 17(*a*) to (*c*) show a catch portion at the tip of the binder of FIG. 10.
Figure 17:
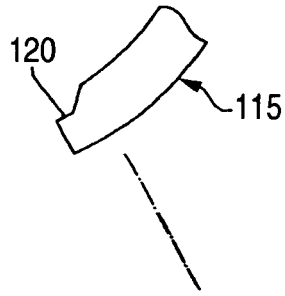
Figure 17:
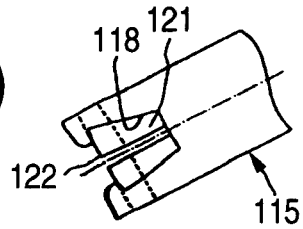

From FIGS. 16(*a*) to (*c*), there is shown in detail a tip of the upper-side ⅓ ring part 114 in scarf joint structure in which the outer peripheral tip portion is cut out in a stepped form and the wedge-shaped planar hook portion 117 formed on a one-step lower step portion 119 is projected forward. From FIGS. 17(*a*) to (*c*), there is shown in detail a tip of the lower-side ⅓ ring part 115 in the scarf joint structure corresponding to the upper-side ⅓ ring part 114, in which structure the inner peripheral tip portion is cut out to form a step portion 120 as well as the wedge-shaped catch portion 118 corresponding to the hook portion 117 on the outer peripheral side. Further, a circumferential slot 122 for receiving the hook portion 117 by subjecting the catch portion 118 to elastic deformation at the time of inserting the hook portion is formed in the inner base 121 of the catch portion 118.

Figure 18:
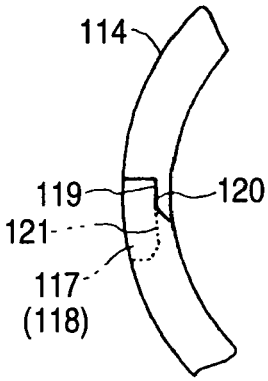
FIG. 18(*a*) is a sectional side view showing a ring forming condition concerning the binder of FIG. 10.
Figure 18:
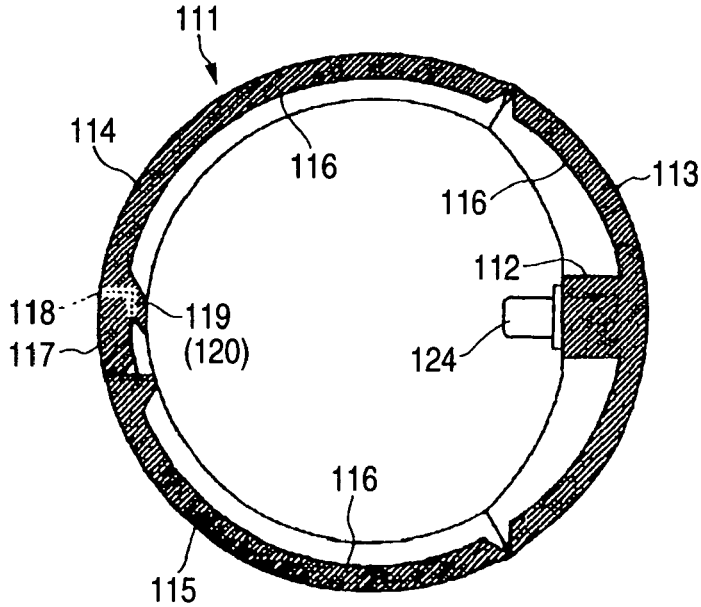

FIGS. 18(*a*) and (*b*) show a ring formed by engaging the hook portion 117 of the upper-side ⅓ ring part 114 with the catch portion 118 of the lower-side ⅓ ring part 115. Thus, the upper-side ⅓ ring part 114 and the lower-side ⅓ ring part 115 are prevented from slipping out of place in circumferential and lateral directions as the hook portion 117 and the catch portion 118 are engaged together in the scarf joint structure at the tips of the upper-side ⅓ ring part 114 and the lower-side ⅓ ring part 115, both the ⅓ ring parts 114 and 115 are so fixed as to be prevented from mutually slipping out in the radial direction. In other words, since the hook portion 117 is mounted on the inner base 121 of the catch portion 118 of the lower-side ⅓ ring part 115, the upper-side ⅓ ring part 114 will never shift to and from the lower-side ⅓ ring part 115 in case where external force is applied to the upper-side ⅓ ring part 114 in the direction of the center of the ring or where external force is applied to the lower-side ⅓ ring part 115 in the direction outside the ring. Since the step portion 120 of the lower-side ⅓ ring part 115 is mounted on the step portion 119 of the upper-side ⅓ ring part 114, moreover, the upper-side ⅓ ring part 114 will never shift to and from the lower-side ⅓ ring part 115 in case where external force is applied to the upper-side ⅓ ring part 114 in the direction outside the ring or where external force is applied to the lower-side ⅓ ring part 115 in the direction of the center of the ring. When the binder 111 is removed from documents, the catch portions 118 are opened laterally by pulling the upper-side ⅓ ring parts 114 and lower-side ⅓ ring parts 115 laterally in the circumferential direction so as to release the engaging of the catch portions 118 with the hook portions 117; the binder 111 thus removed are naturally reusable accordingly.

As shown in FIG. 11(*a*) to FIG. 13(*b*), pins 124 projecting toward the centers of the respective rings are formed at constant intervals on the inner surface side of the spine portion 112 (five pins according to this embodiment of the invention), and slits 125 and 126 making a engaging pair with the pins 124 are formed on the back side of the spine portion 112. Therefore, the pins 124 are fitted into the slits 125 and 126 of the binder 111 in the front row when the plurality of binders 111 are stacked up as shown in FIG. 14, whereby the plurality of binders 111 are coupled together and as the plurality of binders 111 are prevented from coming apart, the binders 111 become easy to handle when the binders are unpacked and when the binding machine is charged with the binders.

Figure 19:
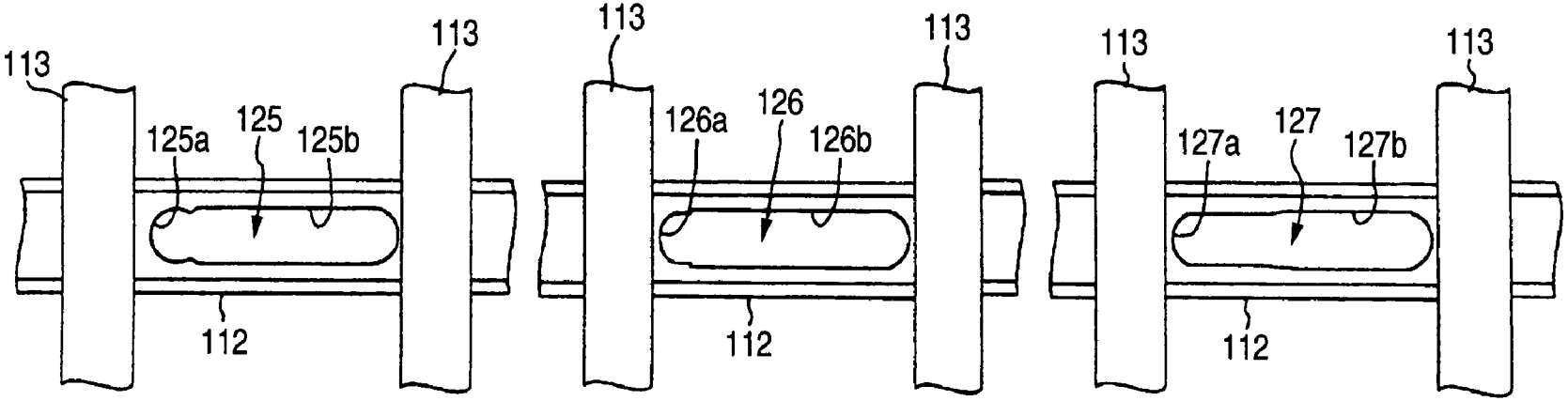
FIGS. 19(*a*) to (*c*) show a spine portion of the binder.
Figure 20:
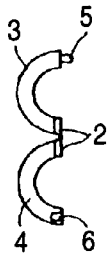
FIG. 20 (a) PRIOR ART
FIGS. 20(*a*) and (*b*) show a conventional binder.
Figure 20:
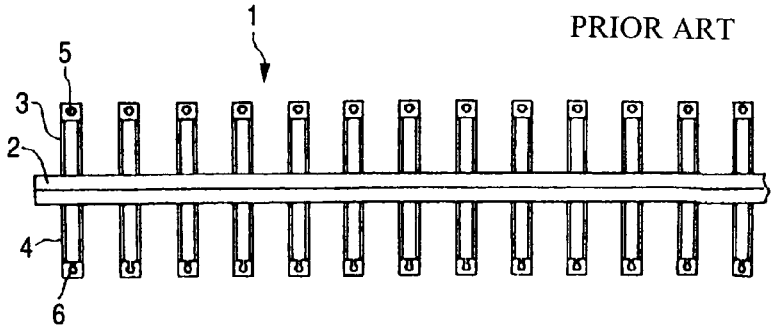
FIG. 20 (b) PRIOR ART
Figure 21:
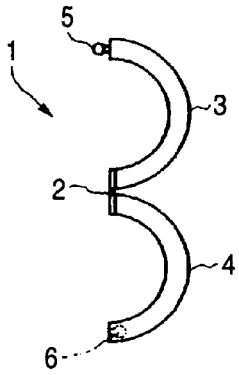
FIG. 21 (a) PRIOR ART
FIGS. 21(*a*) and (*b*) show the conventional binder.
Figure 21:
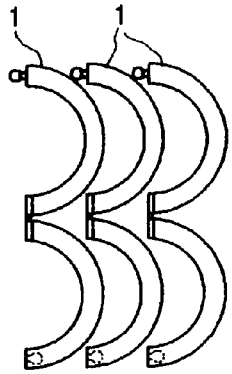
FIG. 21 (b) PRIOR ART
Figure 22:
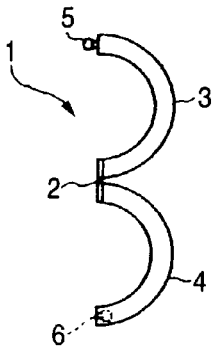
FIG. 22 (a) PRIOR ART
FIGS. 22(*a*) and (*b*) show the conventional binder.
Figure 22:
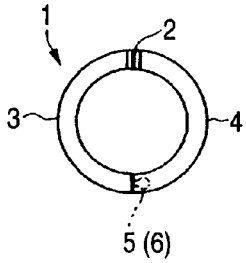
FIG. 22 (b) PRIOR ART

FIGS. 19(*a*) to (*c*) show the slits 125 and 126 in detail: FIG. 19(*a*) shows the central slit 125 in FIG. 10; and FIG. 19(*b*), the four slits 126 other than the central one, each being shown in four lateral places. The slits 125 and 126 are laterally oblong in configuration and when the plurality of binders 111 are stacked up by truing up both edges of the boards, the pins 124 of the binders 111 in the back row face the left end portions of the slits 125 and 126 in the front row. The left ends of the slits 125 and 126 are pin hole portions 125*a* and 126*a* having the same width as the diameter of the pin 124 or a width slightly narrower than the diameter thereof and the width of any portion other than the pin hole portions 125*a* and 126*a* is set greater than the diameter of the pin 124. When the plurality of binders 111 are held down longitudinally by truing up both edges of the boards, the pins 124 are fitted into the left-end pin hole portions 125*a* and 126*a* of the slits 125 and 126, so that the longitudinal binders 111 are combined. When the front side binder 111 out of the two binders 111 engaged together in FIG. 10 is slid leftward, the slits 125 and 126 are moved leftward with respect to the pins 124 and the pin hole portions 125*a* and 126*a* of the slits 125 and 126 are released from engaging with the pins 124, whereby the binders 111 are separated.

In the case of mechanizing the binding process, it is considered necessary to provide a binder feed mechanism and a binder separating mechanism to the binding machine. However, on condition that a mechanism for pushing a binder in the front row is installed when the binders 111 above are used, the binder in the front row out of a group of binders coupled together can be separated, so that such a binder separating mechanism can simply be formed.

Although the slit 126 shown in FIG. 19(*b*) is formed with the pin hole portion 126*a* and a right-side broad slit portion 126*b* to form a linear slit, the width of the joint region of the central slit 125 shown in FIG. 19(*a*) formed with the pin hole portion 125*a* and the broad slit portion 125*b* is narrow. Consequently, a click stop function for holding the pin 124 within the pin hole portion 125*a* is provided, so that the plurality of binders 111 coupled together are prevented from sliding because of vibration. In this case, any slit 126 other than the central slit 125 may be in the click stop form as shown in FIG. 19(*a*) but the binders 111 can simply be separated without applying force for sliding purposes on condition that any slit 126 other than the central slit 125 is formed so that the pin 124 is easily slidable as in the case of the example above.

A slit 127 shown in FIG. 19(*c*) refers to a modified example of the slit 126 shown in FIG. 19(*b*) and is formed with a pin hole portion 127*a* as a parallel linear slit that is long sideways and is continuous in configuration to the broad slit portion 127. By making the pin hole portion 127*a* long sideways, it is ensured that the other pin 124 is fitted into the pin hole portion 127*a* even in case that there occurs a slight pitch shift between the pin 124 and the slit 127 when the central pin 124 is fitted into the pin hole portion 125*a* of the central slit 125 and the possibility of defective engaging due to a relative positional deviation resulting from a molding tolerance is obviated.

Figure 4:
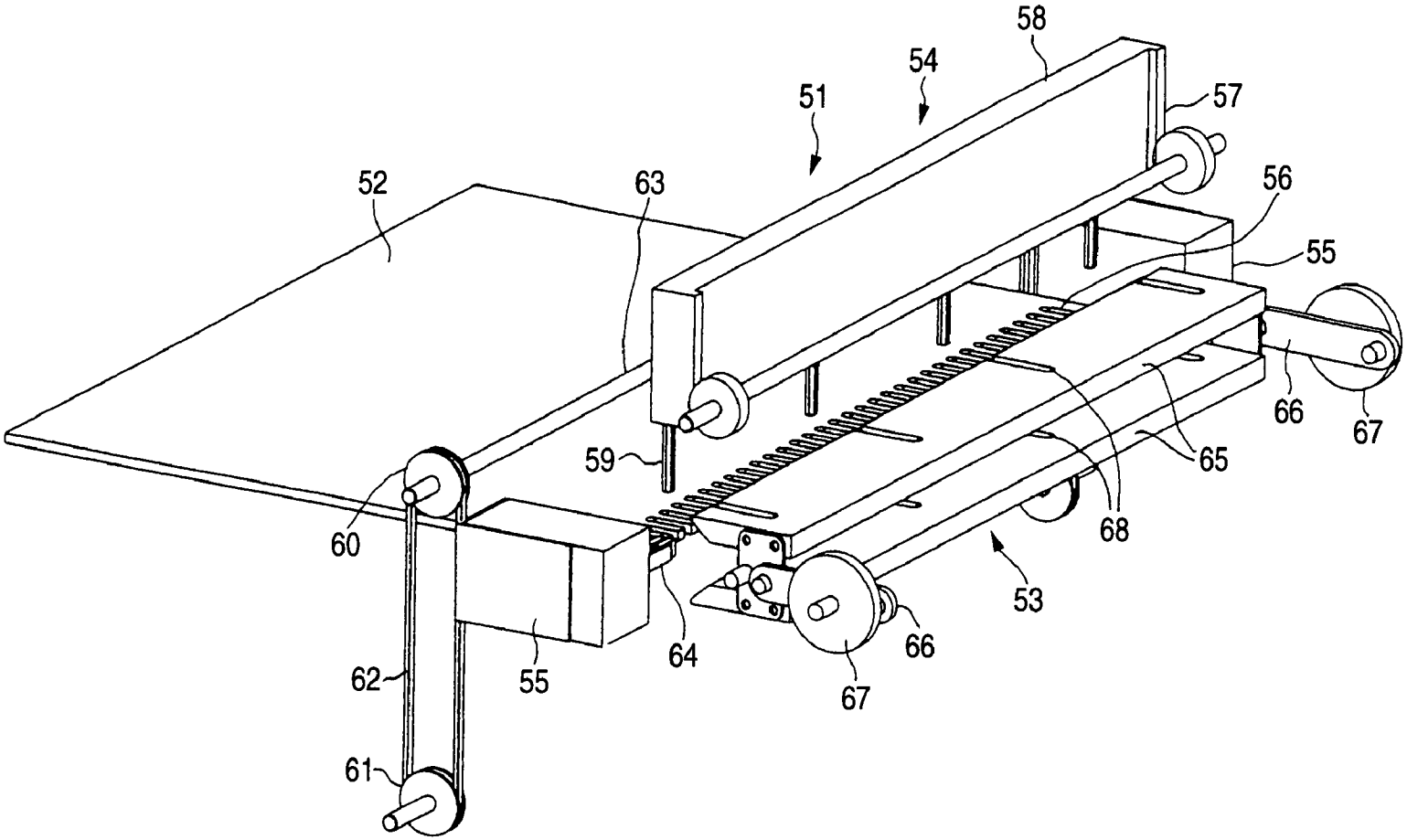
FIG. 4 is a perspective view of the back side of a binding apparatus.
Figure 5:
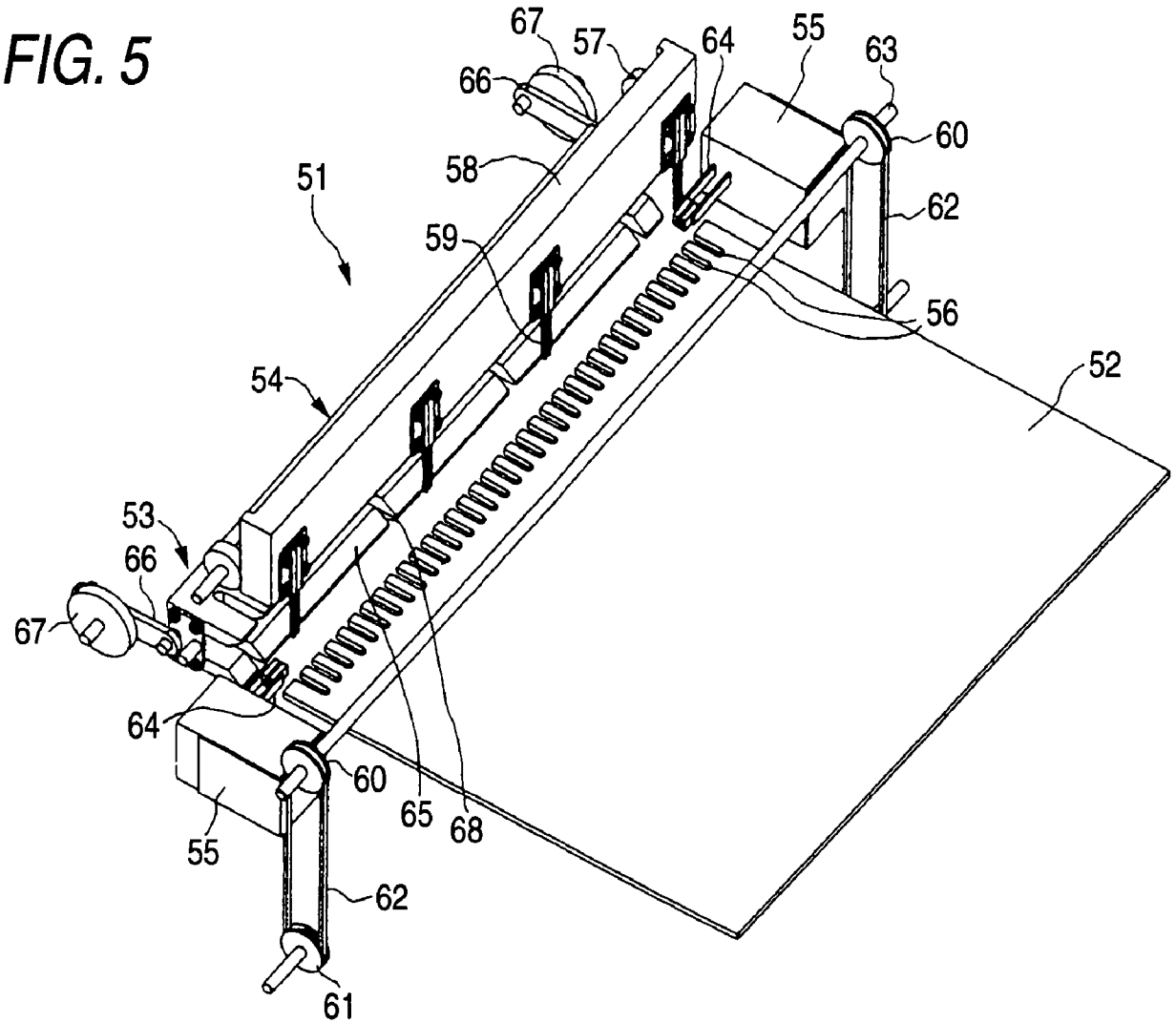
FIG. 5 is a perspective view of the front side of the binding apparatus.

A binding apparatus using the binders will now be described. FIGS. 4 and 5 show a binding apparatus 51 having a paper table 52. A binding portion 53 for closing plastic binders by moving forward is provided in the rear of the paper table 52 (right-hand side of FIG. 4) and a stopper portion 54 for positioning paper and the binder is disposed above the binding portion 53. Further, binder holding portions 55 are disposed slightly ahead of the stopper portion 54 and on both the respective right and left of the paper table 52.

Many slits 56 are cut as if forming teeth of a comb at constant intervals in the rear edge portion of the paper table 52 and a slit-to-slit space conforms to a space between punched holes of loose-leaf paper. The stopper portion 54 is fitted with stopper pins 59 like square bars at constant intervals on the front of a plate 58 to be moved upward and downward by a rack and pinion mechanism 57. The stopper pins 59 are suspended downward from the plate 58 and when the stopper portion 54 is moved down, the lower end of each stopper pin 59 is located lower than the paper table 52 but when the stopper portion 54 is moved upward, the stopper pins 59 retreat upward the paper table 52.

Each of the binder holding portions 55 is latched on a belt 62 stretched between two upper and lower pulleys 60 and 61, and the upper right and left pulleys 60 are coupled by a synchronous shaft 63, whereupon the right and left binder holding portions 55 are moved upward and downward synchronously by driving the lower pulleys 61 by motors (not shown). Open-and-close pinch portions 64 are provided on the sides opposite to the respective binding holding portions 55, which clutch both ends of the spine portion of the binder by opening and closing the pinch portions 64, using driving means such as solenoids.

The binding portion 53 has a pair of horizontal plates 65 vertically disposed in parallel to each other and inner opposed sides of the front end portions of the plates 65 are inclined to form a V-shaped opening in cross section as shown in FIG. 5. The binding portion 53 is coupled to crank plates 67 via links 66 and longitudinally reciprocates in response to the movement of the crank plates 67 driven to rotate by motors (not shown). Moreover, vertically long slits 68 corresponding to the stopper pins 59 of the stopper portion 54 are formed in the front of the pair of vertical plates 65 forming the binding portion 53, so that the binding portion 53 is allowed to advance in the direction of the paper table 52 without interfering the stopper pins 59.

Figure 6:
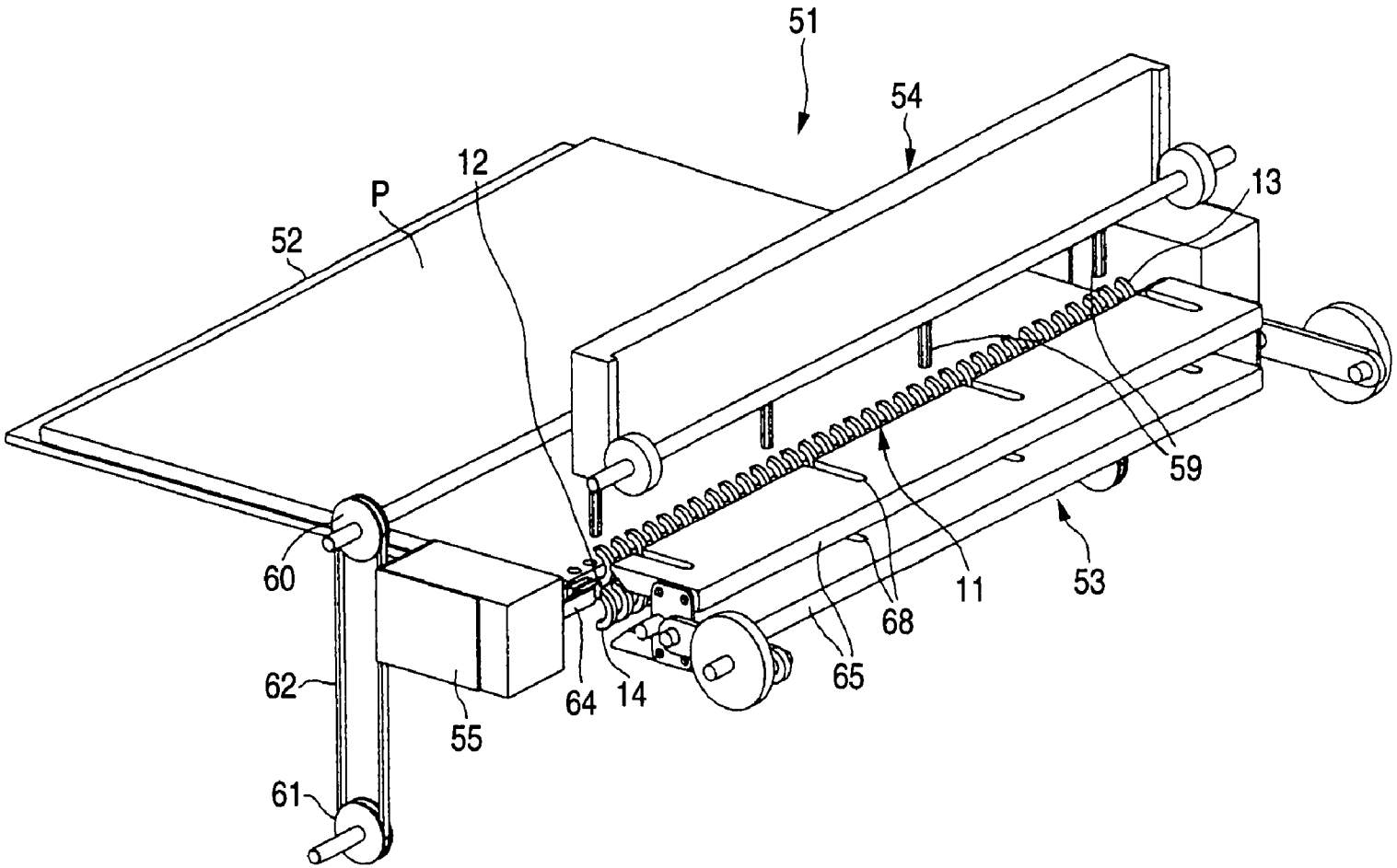
FIG. 6 is a perspective view of the back side of the binding apparatus in a standby condition.
Figure 7:
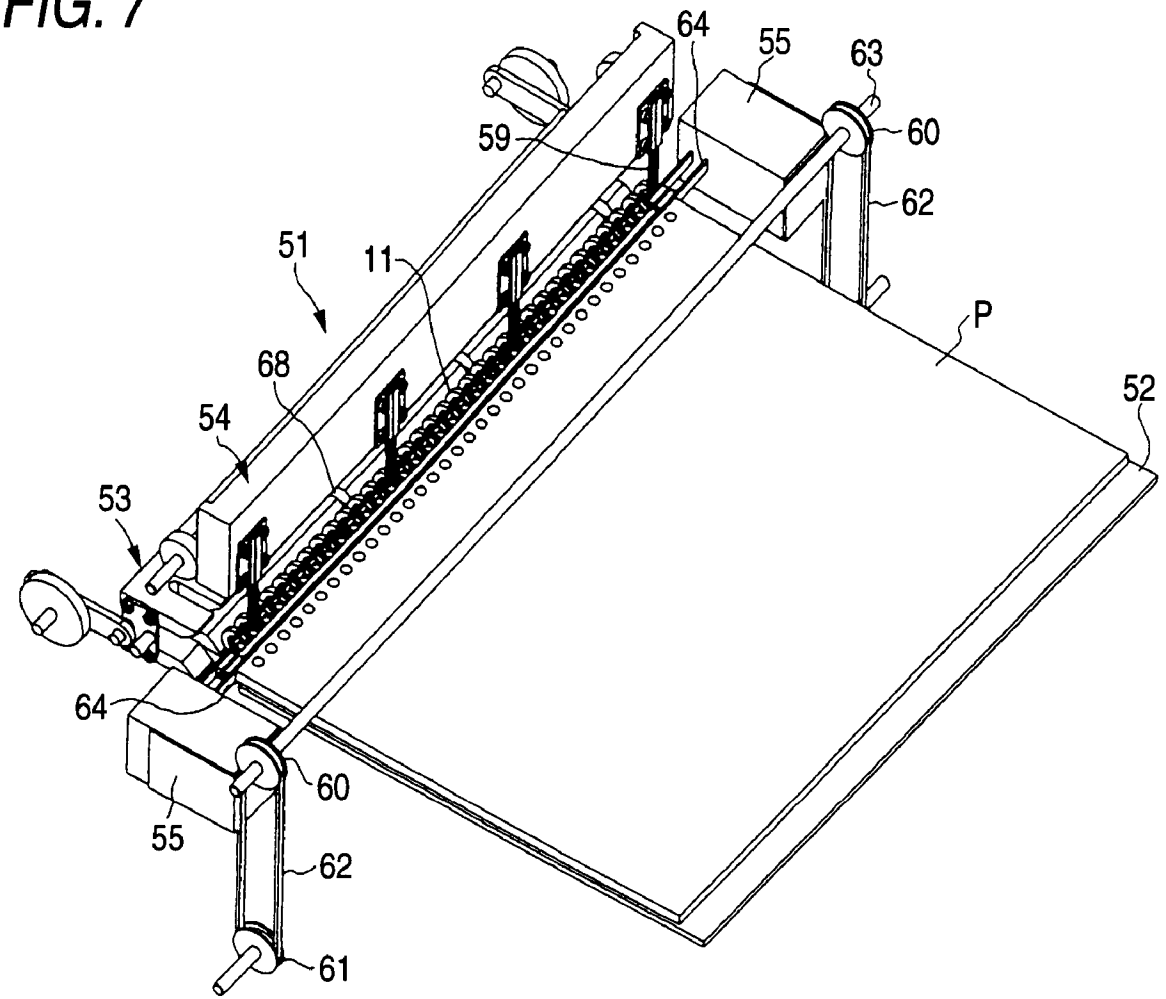
FIG. 7 is a perspective view of the front side of the binding apparatus in the standby condition.
Figure 8:
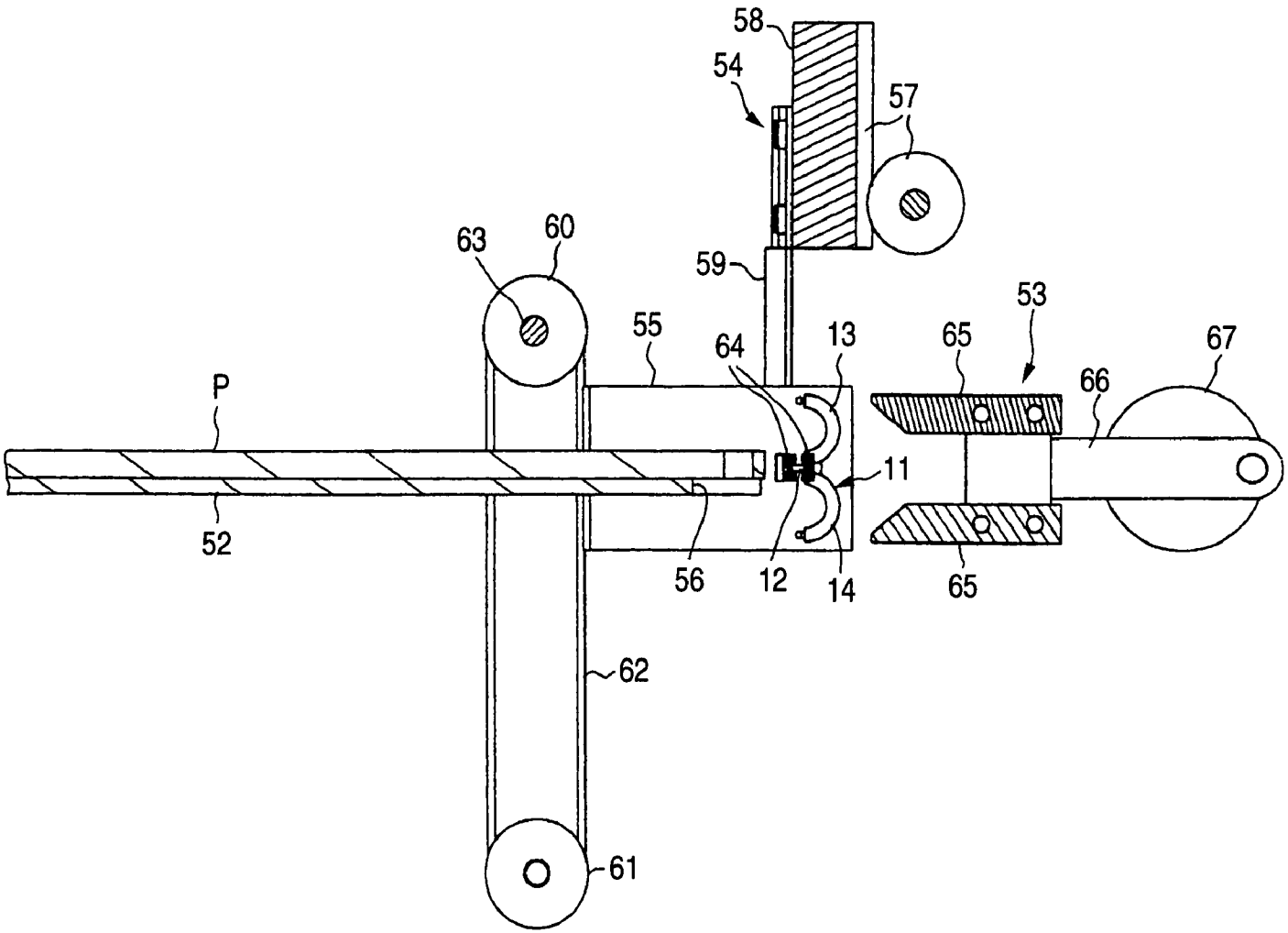
FIG. 8 is a sectional side view of the binding apparatus in the standby condition.

Subsequently, the operation of the binding apparatus 51 will be described. When the power is turned on, the right and left binder holding portions 55 move downward into a binder stoker (not shown) under the paper table 52 to put each end of the spine portion of the binder in between the pinch portions 64 by opening the pinch portions 64 and then move upward after holding the binder by closing the pinch portions 64, so that the binder 11 is set to face the rear edge of the paper table 52 as shown in FIG. 6 to FIG. 8. Simultaneously, the stopper portion 54 moves downward, whereupon the stopper pins 59 are inserted into the slits 56 of the paper table 52, and the stopper portion 54 assumes a standby condition so as to wait for paper setting.

Figure 9:
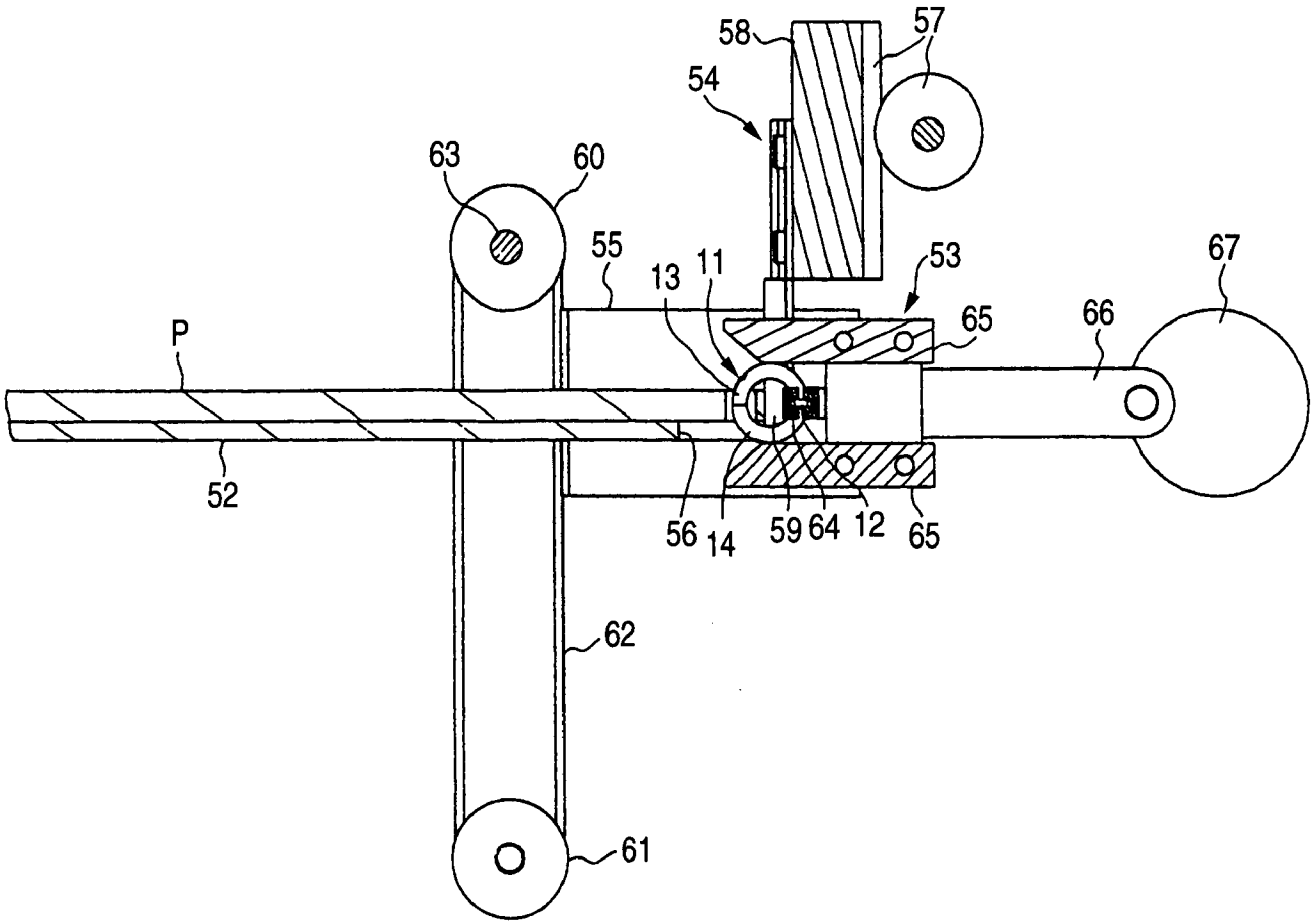
FIG. 9 is a sectional side view of the binding apparatus on completion of a binding operation.

In the standby condition, sheets of loose-leaf paper P are mounted on the paper table 52 and positioned properly by abutting the back of the loose-leaf paper P against the front of the stopper pins 59. When a start switch button (not shown) is pressed, the binding portion 53 advances and pushes the binder 11 forward from behind and as the spine portion 12 of the binder 11 abuts against the stopper pins 59 at this time, the spine portion 12 is prevented from being forced out forward. Consequently, the upper and lower ½ ring parts 13 and 14 are caused to abut against the inclined faces of the V-shaped opening in cross section of the binding portion 53 and pivoted in the closing direction, whereby the upper and lower ½ ring parts 13 and 14 are engaged in the holes of the loose-leaf paper P as shown in FIG. 9.

Upon the completion of the binding operation, the binding portion 53 is retreated and the stopper portion 54 moves upward whereby to make the stopper pins 59 retreat from the front of the spine portion 12 of the binder 11. Thus, the loose-leaf paper P in a bound condition is ready for being taken out of the paper table 52 and the binder holding portions 55 move downward to the binder stoker (not shown), return to the standby condition after clutching next binder 11 and complete one-cycle operation.

In this case, an arrangement may be made so that a start switch is automatically started to perform the one-cycle operation after sheets of paper are set on the paper table by mounting a paper detection sensor to the paper table instead of manually operating the start switch to perform the one-cycle operation. Moreover, a paper feed mechanism for pulling sheets of paper into the paper table may be provided so as to perform a series of operations including binding sheets of paper up to discharging the paper or a binding apparatus may be mounted in a composite machine having a copying machine, a multiple-hole paper puncher and so on in combination in order to perform copying, punching and binding processes collectively.

However, the invention is not limited to the above-described embodiments of the invention but may be changed and modified without departing from the technical scope thereof and needless to say extended over any of modified examples.

The present application for patent is based on Japanese Patent Application dated on Apr. 30, 2002 (Application No. 2002-129236 for Patent) and Japanese Patent Application dated on Feb. 6, 2003 (Application No. 2003-029302 for Patent) and their contents are taken in this description for reference.

INDUSTRIAL APPLICABILITY

As set forth above, the binder can be fitted to sheets of loose-leaf paper by the binding apparatus of the invention without relying on manual work and hence the process of binding up documents is performed very quickly, which has the effect of not only promoting labor saving but improving efficiency of processing paperwork.

Further, the binder according to the invention is different from the conventional ones in that the former is so structured that the spine portion itself is not designed to open and close and it is ensured that the binder is held by the binding apparatus intended to perform the operation of holding and closing the binder. Accordingly, the invention makes it possible to put this binding system to practical use.

Further, as a plurality of binders can be stacked up compactly, the binders are by far easier to handle when carried or loaded into the binding machine, so that space efficiency is improved when the binders are packed into a packaging box or the binding machine. Moreover, spine portions of the binders thus stacked up are kept in contact with each other, whereupon the binders are prevented from being bent even though the push load is applied by the feed mechanism of the binding machine to the spine portion. Thus, the mechanization of the binding process can be dealt with.

Further, as the binder is provided with the engaging means such as pins and slits, the binders in a stacked-up condition are not separated and become by far easier to handle when carried or loaded into the binding machine. Since it has been arranged that the stacked-up binders are released from engaging together by mutually sliding them, a binder separating mechanism simple in construction can be devised when it is attempted to mechanize the binding process. Therefore, the invention can contribute to simplifying the structure of such a mechanism.

Further, as the binder according to the invention employs the scarf joint structure as means for engaging the tips of the split ring parts in combination with the mortise and tenon joint structure with the hook and the catch portions, a linear slide mold may be used to form the binder, so that the molding cost is considerably decreased in comparison with the rotary drawing metal mold required for the conventional binder. The ring part of the binder can be made thinner than that of the conventional binder whose ring engaging means is formed with a tip expansion type pin and a hole corresponding in configuration to the tip, whereby the number of sheets of paper to be bound up can be increased. The possibility that the engaging of the split ring parts may be broken by the radial external force is obviated by forming the hook portion on the surface side of the front step portion of the split ring part on one side and the catch portion on the undersurface side of the step portion of the split ring part on the other. Moreover, the formation of the slotted catch portion results in preventing the engaging strength from lowering even though the catch portion is attached to and removed from the hook portion over repeatedly, so that the binder can also be used repeatedly.

The invention claimed is:

1. A binder comprising:

a spine portion; and a plurality of rings arranged at intervals in a longitudinal direction of the spine portion, wherein the rings respectively comprise two or more split ring parts, two split ring parts of the two or more split ring parts are connected to the spine portion on respective sides of the spine portion by thin hinges, and engaging portions are formed on respective ends, opposite to the spine portion, of one or more split ring parts connected to the spine portion, for binding sheets of paper by engaging the engaging portions;

wherein the spine portion is formed so that, when two or more of the binders are stacked, a front face of the spine portion of one of stacked binders is brought into contact with a back face of the spine portion of another of the stacked binders;

a depression formed on one of a front and a back of the spine portion; and a projection formed on the other of the front and the back of the spine portion, the depression is engaged by the projection so that a plurality of binders are connected in a stacked condition.

2. The binder according to claim 1, wherein at least one of the split ring parts is formed so that, when two or more of the binders are stacked, an outer circumference of one of the split ring parts of one of the stacked binders, and an inner circumference of another of the split ring parts of another of the stacked binders are brought into contact with each other on at least one point other than both ends of the inner circumference of said one of the split ring parts.

3. The binder according to claim 1, wherein the depression comprises a slit disposed longitudinally, the slit including a pin hole portion for engaging the projection and an elongated slit portion continuous to the pin hole portion and having a width greater than that of the projection, wherein the engagement between the pin hole portion of one binder and the projection of another binder can be released by sliding the one binder in the longitudinal direction relative to the another binder.

4. The binder according to claim 3, wherein a joint region between the pin hole portion and the elongated slit portion is narrower than the outer diameter of the projection to provide a click stop function for generating a resistance when the projection slidably moves from the pin hole portion to the elongated slit portion.

5. The binder according to claim 1, wherein the engaging portions comprise:

a scarf structure having radial, symmetrical steps at respective ends of split ring parts;

a hook portion formed at one end of the respective ends; and a catch portion formed at the other end of the respective ends for engaging with the hook portion.

6. The binder according to claim 5, wherein the hook portion is formed on a front face side of the step at one end, and the catch portion is formed on a back face side of the step at the other end.

7. The binder according to claim 5, wherein the catch portion comprises a slot.

8. Sheets of loose-leaf paper bound by the binder according to claim 1.

9. A binder comprising:

a spine portion; and a plurality of rings arranged at intervals in a longitudinal direction of the spine portion, wherein the rings respectively comprise two or more split ring parts, at least one of said two or more split ring parts are integrally fixed to the spine portion, the other of said two or more split ring parts is connected by a thin hinge to one of the spine portion and any of the split ring parts, two of the split ring parts being positioned on respective sides of the spine portion, and having engaging portions to bind sheets of paper;

wherein the spine portion is formed so that, when two or more binders are stacked, a front face of the spine portion of one of stacked binders is brought into contact with a back face of the spine portion of another of the stacked binders;

a depression formed on one of a front and a back of the spine portion; and a projection formed on the other of the front and the back of the spine portion, the depression is engaged by the projection so that a plurality of binders are connected in a stacked condition.

10. The binder according to claim 9, wherein said two or more split ring parts comprise:

an intermediate split ring part integrally fixed to the spine portion; and a first and a second outer split ring parts connected to respective ends of the intermediate split ring part.

11. The binder according to claim 10, wherein the intermediate ring part is formed so that, when two or more binders are stacked, an outer circumference of the intermediate ring part of one of the stacked binders and an inner circumference of the intermediate ring part of another of the stacked binders are brought into contact with each other on at least one point other than both ends of the inner circumference of the intermediate ring part of the another of the stacked binders.

12. The binder according to claim 9, wherein at least one of the split ring parts is formed so that, when two or more binders are stacked, an outer circumference of one of the split ring parts of one of the stacked binders, and an inner circumference of another of the split ring parts of another of the stacked binders are brought into contact with each other on at least one point other than both ends of the inner circumference of said another of the split ring parts.

13. The binder according to claim 9, wherein outer and inner circumferences of at least one of the split ring parts are formed to have approximately the same curvature.

14. The binder according to claim 9, wherein the depression comprises a slit disposed longitudinally, the slit including a pin hole portion for engaging the projection and an elongated slit portion continuous to the pin hole portion and having a width greater than that of the projection, wherein the engagement between the pin hole portion of one binder and the projection of another binder can be released by sliding the one binder in the longitudinal direction relative to the another binder.

15. The binder according to claim 14, wherein a joint region between the pin hole portion and the elongated slit portion is narrower than the outer diameter of the projection to provide a click stop function for generating a resistance when the projection slidably moves from the pin hole portion to the elongated slit portion.

16. The binder according to claim 9, wherein the engaging portions comprise:

a scarf structure having radial, symmetrical steps at respective ends of split ring parts;

a hook portion formed at one end of the respective ends; and a catch portion formed at the other end of the respective ends for engaging with the hook portion.

17. The binder according to claim 16, wherein the hook portion is formed on a front face side of the step at one end, and the catch portion is formed on a back face side of the step at the other end.

18. The binder according to claim 16, wherein the catch portion comprises a slot.

19. Sheets of loose-leaf paper bound by the binder according to claim 9.

20. A binder comprising:

a spine portion; and a plurality of rings arranged at intervals in a longitudinal direction of the spine portion, wherein the rings respectively comprise two or more split ring parts, wherein said two or more split ring parts comprise:

an intermediate split ring part integrally fixed to the spine portion; and a first and a second outer split ring part connected to respective ends of the intermediate split ring part;

wherein outer and inner circumferences of the intermediate ring part are formed to have approximately the same curvature.

21. A method for binding sheets of loose-leaf paper having holes, by a binder having a spine portion and a ring with split ring parts, comprising:

clutching both ends of the spine portion directly;

pivoting the split ring parts in the closing direction of the split ring parts; and engaging the split ring parts within the holes of the sheets of loose-leaf paper.

22. The method according to claim 21, further comprising:

advancing a binding portion of a binding apparatus; and pushing the binder forward from behind by the binding portion so that the spine portion abuts against a stopper pins of the binding apparatus and the spine portion is prevented from being forced out forward.

23. The method according to claim 22, wherein in the step of clutching, a pinch portion of the binding apparatus clutches both ends of the spine portion.

24. The method according to claim 21, further comprising:

mating of the engaging members within the confines of the holes of the sheets of loose-leaf paper.

25. A binder comprising:

a spine portion; and a plurality of rings arranged at intervals in a longitudinal direction of the spine portion, wherein the rings respectively comprise three split ring parts, one of said three ring parts is integrally fixed to the spine portion, the other two of said three split ring parts are respectively connected by thin hinges to said one of said three split ring parts;

further comprising:

a depression formed on one of a front and back of the spine portion; and a projection formed on the other of the front and the back of the spine portion, the depression is engaged by the projection so that a plurality of binders are connected in a stacked condition.

26. A binder comprising:

a spine portion; and a plurality of rings arranged at intervals in a longitudinal direction of the spine portion, wherein the rings respectively comprise two or more split ring parts, two split ring parts of the two or more split ring parts are connected to the spine portion on respective sides of the spine portion by thin hinges, and engaging portions are formed on respective ends, opposite to the spine portion, of one or more split ring parts connected to the spine portion, for binding sheets of paper by engaging the engaging portions;

wherein outer and inner circumferences of at least one of the split ring parts are formed to have substantially the same curvature;

wherein a center of curvature of the inner circumferences and a center of curvature of the outer circumferences are not located in the same position.

27. A binder comprising:

a spine portion; and a plurality of rings arranged at intervals in a longitudinal direction of the spine portion, wherein each of the rings comprises an intermediate split and first and second outer split ring parts connected to respective ends of the intermediate split ring part, the intermediate split ring part is integrally fixed to the spine portion, the first and second outer split ring parts are connected to respective ends of the intermediate split ring part, the first and second outer split ring parts respectively have engaging portions to bind sheets of paper;

wherein the spine portion is formed so that, when two or more binders are stacked, a front face of the spine portion of one of stacked binders is brought into contact with a back face of the spine portion of another of the stacked binders, wherein outer and inner circumstances of the intermediate split ring part are formed to have substantially a same curvature.

28. The binder according to claim 27, wherein a center of curvature of the inner circumferences and a center of curvature of the outer circumferences are not located in the same position.

* * * * *